US007312007B2

(12) United States Patent
Lin et al.

(10) Patent No.: US 7,312,007 B2
(45) Date of Patent: Dec. 25, 2007

(54) PHOTOCONDUCTIVE IMAGING MEMBERS

(75) Inventors: Liang-Bih Lin, Webster, NY (US); Jin Wu, Webster, NY (US); Geoffrey M T. Foley, Fairport, NY (US); Yonn K. Rasmussen, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 443 days.

(21) Appl. No.: 10/942,277

(22) Filed: Sep. 16, 2004

(65) Prior Publication Data

US 2006/0057480 A1 Mar. 16, 2006

(51) Int. Cl.
*G03G 15/04* (2006.01)

(52) U.S. Cl. ..... 430/65

(58) Field of Classification Search ..... 430/65
See application file for complete search history.

(56) References Cited

U.S. PATENT DOCUMENTS

| | | | | |
|---|---|---|---|---|
| 3,121,006 | A | 2/1964 | Middleton et al. | 96/1 |
| 4,265,990 | A | 5/1981 | Stolka et al. | 430/59 |
| 4,921,769 | A | 5/1990 | Yuh et al. | 430/64 |
| 4,988,597 | A | 1/1991 | Spiewak et al. | 430/62 |
| 5,063,125 | A | 11/1991 | Yuh et al. | 430/59 |
| 5,063,128 | A | 11/1991 | Yuh et al. | 430/63 |
| 5,244,762 | A | 9/1993 | Spiewak et al. | 430/64 |
| 5,482,811 | A | 1/1996 | Keoshkerian et al. | 430/135 |
| 5,489,496 | A * | 2/1996 | Katayama et al. | 430/62 |
| 5,612,157 | A | 3/1997 | Yuh et al. | 430/58 |
| 5,958,638 | A * | 9/1999 | Katayama et al. | 430/65 |
| 6,200,716 | B1 | 3/2001 | Fuller et al. | 430/64 |
| 6,218,062 | B1 | 4/2001 | Yuh et al. | 430/59.1 |
| 6,261,729 | B1 | 7/2001 | Yuh et al. | 430/65 |
| 6,287,737 | B1 | 9/2001 | Ong et al. | 430/58.8 |
| 6,444,386 | B1 | 9/2002 | Liu et al. | 430/64 |
| 6,913,863 | B2 * | 7/2005 | Wu et al. | 430/58.8 |
| 6,967,069 | B2 * | 11/2005 | Wu et al. | 430/59.4 |
| 2004/0126689 | A1 | 7/2004 | Nozomu et al. | |
| 2004/0161682 | A1 | 8/2004 | Wu et al. | |
| 2004/0161684 | A1 * | 8/2004 | Wu et al. | 430/65 |

FOREIGN PATENT DOCUMENTS

EP 0 696 763 A 2/1996

OTHER PUBLICATIONS

Duff, James M. et al., Copending U.S. Appl. No. 10/408,201, filed Apr. 4, 2003 on Photoconductive Imaging Members.
Duff, James M. et al., Copending U.S. Appl. No. 10/408,204, filed Apr. 4, 2003 on Imaging Members.

* cited by examiner

*Primary Examiner*—Mark A. Chapman
(74) *Attorney, Agent, or Firm*—Eugene O. Palazzo

(57) ABSTRACT

A photoconductive member containing a hole blocking layer, a photogenerating layer, and a charge transport layer, and wherein the hole blocking layer contains a metallic component like a titanium oxide and a polymeric binder.

33 Claims, No Drawings

PHOTOCONDUCTIVE IMAGING MEMBERS

CROSS-REFERENCE TO RELATED APPLICATIONS

Illustrated in U.S. Pat. No. 6,.858,363 entitled Photoconductive Imaging Members, the disclosure of which is totally incorporated herein by reference, is a photoconductive member comprised of a supporting substrate, a hole blocking layer thereover, a photogenerating layer, and a charge transport layer, and wherein the hole blocking layer is comprised of a metallic component and an electron transport component.

Illustrated in U.S. Ser. No. 10/408,204, filed Apr. 4, 2003, U.S. Publication No. 20040197685, entitled Imaging Members, the disclosure of which is totally incorporated herein by reference, is a photoconductive imaging member comprised of a supporting substrate, and thereover a single layer comprised of a mixture of a photogenerator component, charge transport components, and a certain electron transport component, and a certain polymer binder.

Illustrated in copending application U.S. Ser. No. 10/144,147, entitled Imaging Members, filed May 10, 2002, Publication No. 20030211413, now abandoned, the disclosure of which is totally incorporated herein by reference, is a photoconductive imaging member comprised of a supporting substrate, and thereover a single layer comprised of a mixture of a photogenerator component, a charge transport component, an electron transport component, and a polymer binder, and wherein the photogenerating component is a metal free phthalocyanine.

The appropriate components and processes of the above copending applications may be selected for the present invention in embodiments thereof.

BACKGROUND

This invention is generally directed to imaging members, and more specifically, the present invention is directed to multilayered photoconductive members with a hole blocking layer comprised, for example, of a suitable hole blocking component of, for example, a titanium oxide, and a binder or polymer. The blocking layer, which can also be referred to as an undercoat layer and possesses conductive characteristics in embodiments, enables, for example, high quality developed images or prints, excellent imaging member lifetimes and thicker layers which permit excellent resistance to charge deficient spots, or undesirable plywooding, and also increases the layer coating robustness, and wherein honing of the supporting substrates may be eliminated thus permitting, for example, the generation of economical imaging members. The hole blocking layer is preferably in contact with the supporting substrate and is preferably situated between the supporting substrate and the photogenerating layer comprised of photogenerating pigments, such as those illustrated in U.S. Pat. No. 5,482,811, the disclosure of which is totally incorporated herein by reference, especially Type V hydroxygallium phthalocyanine.

The imaging members of the present invention in embodiments exhibit excellent cyclic/environmental stability, and substantially no adverse changes in their performance over extended time periods since the imaging members comprise a mechanically robust and solvent thick resistant hole blocking layer enabling the coating of a subsequent photogenerating layer thereon without structural damage, and which blocking layer can be easily coated on the supporting substrate by various coating techniques of, for example, dip or slot-coating. The aforementioned photoresponsive, or photoconductive imaging members can be negatively charged when the photogenerating layer is situated between the charge transport layer and the hole blocking layer deposited on the substrate.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 500 to about 900 nanometers, and in particular from about 650 to about 850 nanometers, thus diode lasers can be selected as the light source. Moreover, the imaging members of this invention are useful in color xerographic applications, particularly high-speed color copying and printing processes.

REFERENCES

Illustrated in U.S. Pat. No. 6,444,386, the disclosure of which is totally incorporated herein by reference, is a photoconductive imaging member comprised of an optional supporting substrate, a hole blocking layer thereover, a photogenerating layer, and a charge transport layer, and wherein the hole blocking layer is generated from crosslinking an organosilane (I) in the presence of a hydroxy-functionalized polymer (II)

(I)

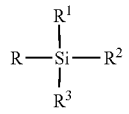

(II)

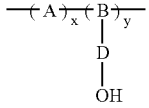

wherein R is alkyl or aryl; $R^1$, $R^2$, and $R^3$ are independently selected from the group consisting of alkoxy, aryloxy, acyloxy, halide, cyano, and amino; A and B are, respectively, divalent and trivalent repeating units of polymer (II); D is a divalent linkage; x and y represent the mole fractions of the repeating units of A and B, respectively, and wherein x is from about 0 to about 0.99, and y is from about 0.01 to about 1, and wherein the sum of x+y is equal to about 1.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer generated, for example, from the reaction of a silyl-functionalized hydroxyalkyl polymer of Formula (I) with an organosilane of Formula (II) and water

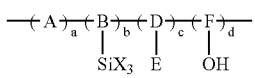

(I)

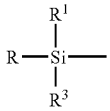

(II)

wherein, for example, A, B, D, and F represent the segments of the polymer backbone; E is an electron transporting moiety; a, b, c, and d are mole fractions of the repeating monomer units such that the sum of a+b+c+d is equal to 1; R is alkyl, substituted alkyl, aryl, or substituted aryl, with the substituent being halide, alkoxy, aryloxy, and amino; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

A number of photoconductive members and components thereof are illustrated in U.S. Pat. Nos. 4,988,597; 5,063,128; 5,063,125; 5,244,762; 5,612,157; 6,218,062; 6,200,716 and 6,261,729, the disclosures of which are totally incorporated herein by reference.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

In U.S. Pat. No. 4,921,769, the disclosure of which is totally incorporated herein by reference, there are illustrated photoconductive imaging members with blocking layers of certain polyurethanes.

SUMMARY

It is a feature of the present invention to provide imaging members with many of the advantages illustrated herein, such as excellent wear characteristics, a thick hole blocking layer that prevents, or minimizes dark injection, and wherein the resulting photoconducting members possess, for example, excellent photoinduced discharge characteristics, cyclic and environmental stability and acceptable charge deficient spot levels arising from dark injection of charge carriers; and in embodiments wherein the phenolic component binder selected for the hole blocking layer is as illustrated in the appropriate copending applications recited herein, and more specifically, wherein the phenolic component contains at least two phenolic groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene) bisphenol), and the like; and yet more specifically, a phenol resin of VARCUM™ 29159, obtained from Oxychem Company; and wherein weight ratio of the phenolic resin and metal oxide is about 90:10 to about 80:20, and more specifically about 40:60.

Another feature of the present invention relates to the provision of layered photoresponsive imaging members, which are responsive to near infrared radiation of from about 700 to about 900 nanometers.

It is yet another feature of the present invention to provide layered photoresponsive imaging members with a sensitivity to visible light, and which members possess improved coating characteristics, and wherein the charge transport molecules do not diffuse, or there is minimum diffusion thereof into the photogenerating layer.

Moreover, another feature of the present invention relates to the provision of layered photoresponsive imaging members with mechanically robust and solvent resistant hole blocking layers.

Aspects of the present invention relate to a photoconductive member comprised of a supporting substrate, a hole blocking layer thereover, a photogenerating layer, and a charge transport layer, and wherein the hole blocking layer is comprised of a metallic component and a binder component; a member comprised of a supporting substrate, a hole blocking layer thereover, a photogenerating layer, and a charge transport layer, and wherein the hole blocking layer is comprised of a metallic component and a binder component, and wherein the metallic component is a titanium dioxide; a photoconductive member comprised in sequence of an optional supporting substrate, a hole blocking layer thereover, a photogenerating layer, and a charge transport layer, and wherein the hole blocking layer is comprised of a titanium oxide or a titanium dioxide component, and a binder component wherein the titanium oxide possesses a primary particle size diameter of from about 12 to about 18 nanometers; a photoconductive imaging member comprised of a supporting substrate, a hole blocking layer thereover, a photogenerating layer and a charge transport layer, and wherein the hole blocking layer is comprised of, for example, a mixture of a metal oxide like $TiO_2$, and a polymer binder, and optionally an electron transport component of, for example, N,N'-bis(1,2-dimethylpropyl)-1,4,5,8-naphthalenetetracarboxylic diimide; a photoconductive imaging member comprised of a hole blocking layer thereover, a photogenerating layer, and a charge transport layer, and wherein the hole blocking layer is comprised of a metallic component, such as for example a particle dispersion of titanium oxide like $TiO_2$, and a suitable resin, and which oxide in embodiments is considered semiconductive, that is for example, a powder resistivity of, for example, from about $5\times10^2$ ohm cm to about $5\times10^4$ ohm cm when applied under a pressure of from about 100 to about 700 $kg/cm^2$, and wherein the metallic component is present in an amount of from about 20 to about 95 weight percent; a member wherein the metallic component is $TiO_2$, and more specifically, a mixture of a titanium oxide, and a polymer or resin binder, such as a phenol resin, and which $TiO_2$ can be considered as possessing semiconductive characteristics optionally present in an amount of from about 30 to about 80 weight percent; a device wherein the metallic compound is $TiO_2$ present in an amount of from about 94 to about 98 weight percent; a photoconductive device containing an electron transport in an amount of, for example, from about 2 to about 50, from about 10 to about 40 weight percent, of N,N'-bis(1,2-dimethylpropyl)-1,4,5,8-naphthalene tetracarboxylic acid; bis(2-heptylimido)perinone; BCFM, butoxy carbonyl fluorenylidene malononitrile; benzophenone bisimide; or a substituted carboxybenzylnaphthaquinone; a photoconductive imaging member wherein the hole blocking layer is of a thickness of about 1 to about 15 microns, or is of a thickness of about 2 to about 6 microns; a photoconductive imaging member comprised in sequence of a supporting substrate, a hole blocking layer, an adhesive layer, a photogenerating layer and a charge transport layer; a photoconductive imaging member wherein the adhesive layer is comprised of a polyester with, for example, an $M_w$ of about 70,000, and an $M_n$ of about 35,000; a photoconductive imaging member wherein the supporting substrate is comprised of a conductive metal substrate; a photoconductive imaging member wherein the conductive substrate is aluminum, aluminized polyethylene terephthalate or titanized polyethylene; a photoconductive imaging member wherein the photogenerator layer is of a thickness of from about 0.05 to about 12 microns; a photoconductive imaging member wherein the charge, such as a hole transport layer, is of a thickness of from about 10 to about 55 microns; a photoconductive imaging member wherein the photogenerating layer is comprised of photogenerating pigments in an amount of from about 10 percent by weight to about 95 percent by weight dispersed in a resinous binder; a photoconductive imaging member wherein the resinous binder for the charge transport and/or the hole blocking layer is selected from the group consisting of phenolic resins, polyesters, polyvinyl butyrals, polycarbonates, polystyrene-b-polyvinyl pyridine, and polyvinyl formals; a photoconductive imaging member wherein the charge transport layers comprise aryl amine molecules, and other known charges, especially hole transports; a photoconductive imaging member wherein the charge transport aryl amines are of the formula

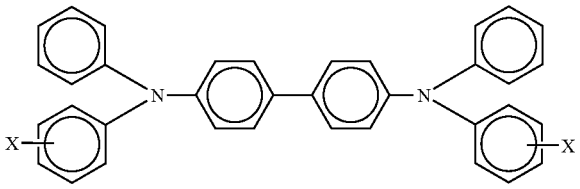

wherein X is alkyl, and wherein the aryl amine is dispersed in a resinous binder; a photoconductive imaging member wherein for the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member further including an adhesive layer of a polyester with an $M_w$ of about 75,000, and an $M_n$ of about 40,000; a photoconductive imaging member wherein the photogenerating layer is comprised of metal phthalocyanines, metal free phthalocyanines, perylenes, hydroxygallium phthalocyanines, chlorogallium phthalocyanines, titanyl phthalocyanines, vanadyl phthalocyanines, selenium, selenium alloys, trigonal selenium, and the like; a photoconductive imaging member wherein the photogenerating layer is comprised of titanyl phthalocyanines, perylenes, or hydroxygallium phthalocyanines; a photoconductive imaging member wherein the photogenerating layer is comprised of Type V hydroxygallium phthalocyanine; and a method of imaging which comprises generating an electrostatic latent image on the imaging member illustrated herein, developing the latent image, and transferring the developed electrostatic image to a suitable substrate.

The hole blocking layers for the imaging members of the present invention may contain an electron transport component selected, for example, from the group consisting of N,N'-bis(1,2-dimethylpropyl)-1,4,5,8-naphthalene tetracarboxylic diimide represented by the following formula

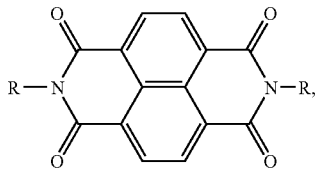

1,1'-dioxo-2-(4-methylphenyl)-6-phenyl-4-(dicyanomethylidene) thiopyran represented by the following formula

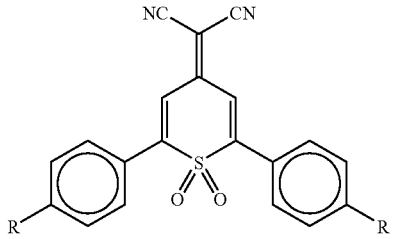

wherein R and R are independently selected from the group consisting of hydrogen, alkyl with, for example, 1 to about 4 carbon atoms, alkoxy with, for example, 1 to about 4 carbon atoms, and halogen; aquinone selected, for example, from the group consisting of carboxybenzylnaphthaquinone represented by the following formula

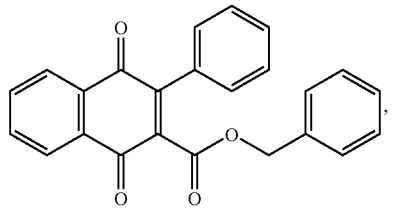

tetra(t-butyl) diphenolquinone represented by the following formula

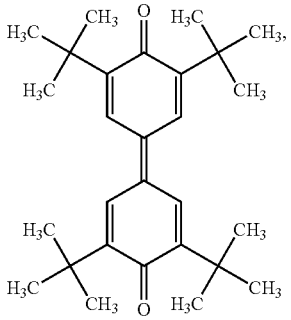

mixtures thereof, and the like; the butoxy derivative of carboxyfluorenone malononitrile; the 2-ethylhexanol of carboxyfluorenone malononitrile; the 2-heptyl derivative of N,N'-bis(1,2-diethylpropyl)-1,4,5,8-naphthalenetetracarboxylic diimide; and the sec-isobutyl and n-butyl derivatives of 1,1-(N,N'-bisalkyl-bis-4-phthalimido)-2,2-biscyano-ethylene.

Specific electron transport components are those that are substantially soluble in a solvent, and which components are, for example, carboxyfluorenone malononitrile (CFM) derivatives represented by

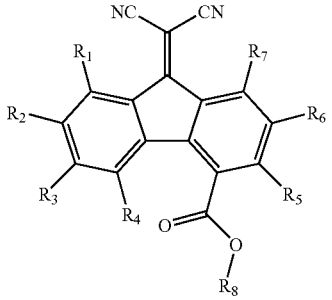

wherein each R is independently selected from the group consisting of hydrogen, alkyl having 1 to about 40 carbon atoms (for example, throughout with respect to the number of carbon atoms), alkoxy having 1 to about 40 carbon atoms, phenyl, substituted phenyl, naphthalene and anthracene; alkylphenyl having 6 to about 40 carbons, alkoxyphenyl having 6 to about 40 carbons, aryl having 6 to about 30 carbons, substituted aryl having 6 to about 30 carbons and halogen; or a nitrated fluorenone derivative represented by

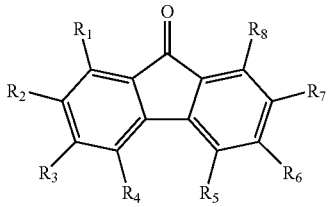

wherein each R is independently selected from the group consisting of hydrogen, alkyl, alkoxy, aryl, such as phenyl, substituted phenyl, higher aromatics such as naphthalene and anthracene, alkylphenyl, alkoxyphenyl, carbons, substituted aryl and halogen, and wherein at least 2 R groups are nitro; a N,N'-bis(dialkyl)-1,4,5,8-naphthalenetetracarboxylic diimide derivative or N,N'-bis(diaryl)-1,4,5,8-naphthalenetetracarboxylic diimide derivative represented by the general formula/structure

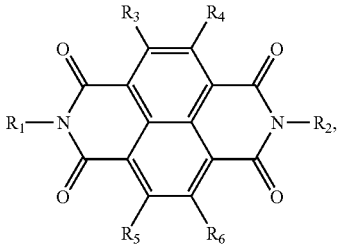

wherein $R_1$ is, for example, substituted or unsubstituted alkyl, branched alkyl, cycloalkyl, alkoxy or aryl, such as phenyl, naphthyl, or a higher polycyclic aromatic, such as anthracene; $R_2$ is alkyl, branched alkyl, cycloalkyl, or aryl, such as phenyl, naphthyl, or a higher polycyclic aromatic, such as anthracene, or wherein $R_2$ is the same as $R_1$; $R_1$ and $R_2$ can independently possess from 1 to about 50 carbons, and more specifically, from 1 to about 12 carbons. $R_3$, $R_4$, $R_5$ and $R_6$ are alkyl, branched alkyl, cycloalkyl, alkoxy or aryl, such as phenyl, naphthyl, or a higher polycyclic aromatic, such as anthracene or halogen, and the like. $R_3$, $R_4$, $R_5$ and $R_6$ can be the same or different; a 1,1'-dioxo-2-(aryl)-6-phenyl-4-(dicyanomethylidene)thiopyran

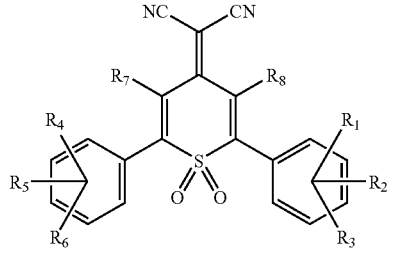

wherein each R is, for example, independently selected from the group consisting of hydrogen, alkyl with 1 to about 40 carbon atoms, alkoxy with 1 to about 40 carbon atoms, phenyl, substituted phenyl, higher aromatics, such as naphthalene and anthracene, alkylphenyl with 6 to about 40 carbons, alkoxyphenyl with 6 to about 40 carbons, aryl with 6 to about 30 carbons, substituted aryl with 6 to about 30 carbons, and halogen; a carboxybenzyl naphthaquinone represented by the following

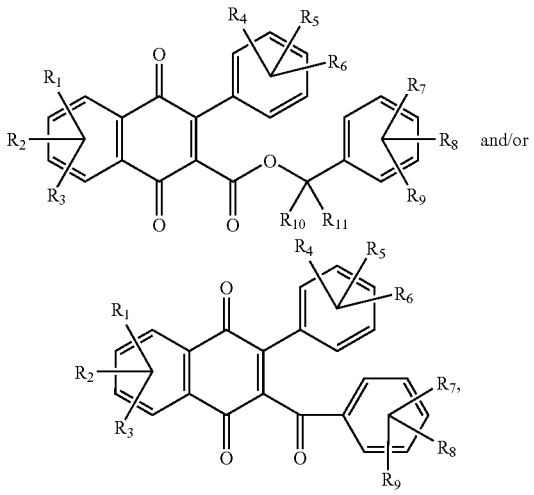

wherein each R is independently selected from the group consisting of hydrogen, alkyl with 1 to about 40 carbon atoms (throughout, carbon chain lengths are intended as examples, and substituents outside the range specified may be selected in embodiments), alkoxy with 1 to about 40 carbon atoms, phenyl, substituted phenyl, higher aromatics such as naphthalene and anthracene, alkylphenyl with 6 to about 40 carbons, alkoxyphenyl with 6 to about 40 carbons, aryl with 6 to about 30 carbons, substituted aryl with 6 to about 30 carbons and halogen; a diphenoquinone represented by the following

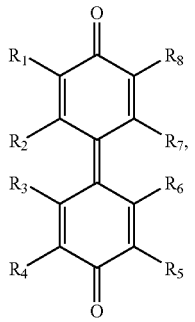

and mixtures thereof, wherein each of the R substituents are as illustrated herein; or oligomeric and polymeric derivatives in which the above moieties represent part of the oligomer or polymer repeat units, and mixtures thereof wherein the mixtures can contain from 1 to about 99 weight percent of one electron transport component and from about 99 to about 1 weight percent of a second electron transport component, and which electron transports can be dispersed in a resin binder, and wherein the total thereof is about 100 percent.

Examples of the hole blocking layer components include $TiO_2$/VARCUM® resin mixture in a 1:1 mixture of n-butanol:xylene containing from about 2 to about 50 weight percent of an added electron transport material based on the total solid concentration in solution, and wherein the aforementioned main component mixture amount is, for example, from about 80 to about 100, and more specifically, from about 90 to about 99 weight percent, and yet more specifically, wherein the titanium oxide possesses a primary particle size diameter of from about 10 to about 25 nanometers, and more specifically, from about 12 to about 17, and yet more specifically, about 15 nanometers with an estimated aspect ratio of from about 4 to about 5, and is optionally surface treated with, for example, a component containing, for example, from about 1 to about 3 percent by weight of alkali metal, such as a sodium metaphosphate, a powder resistance of from about $1\times10^4$ to about $6\times10^4$ ohm/cm when applied at a pressure of from about 650 to about 50 kg/cm$^2$; MT-150W and which titanium oxide is available from Tayca Corporation of Japan, and wherein the hole blocking layer is, more specifically, of a thickness of about 15 microns thereby avoiding or minimizing charge leakage.

The hole blocking layer can in embodiments be prepared by a number of known methods; the process parameters being dependent, for example, on the member desired. The hole blocking layer can be coated as solution or a dispersion onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours, under stationary conditions or in an air flow. The coating can be accomplished to provide a final coating thickness of from about 1 to about 15 microns after drying.

Illustrative examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®. Moreover, the substrate may contain thereover an undercoat layer, including known undercoat layers, such as suitable phenolic resins, phenolic compounds, mixtures of phenolic resins and phenolic compounds, titanium oxide, silicon oxide mixtures like $TiO_2$/$SiO_2$, the components of copending application U.S. Ser. No. 10/144,147, Publication No. 20030211413 (now abandoned), the disclosure of which is totally incorporated herein by reference, and the like.

The thickness of the substrate layer depends on many factors, including economical considerations, thus this layer may be of substantial thickness, for example over 3,000 microns, or of minimum thickness providing there are no significant adverse effects on the member. In embodiments, the thickness of this layer is from about 75 microns to about 300 microns.

The photogenerating layer, which can be comprised of the components indicated herein, such as hydroxychlorogallium phthalocyanine, is in embodiments comprised of, for example, about 50 weight percent of the hyroxygallium or other suitable photogenerating pigment, and about 50 weight percent of a resin binder like polystyrene/polyvinylpyridine. The photogenerating layer can contain known photogenerating pigments, such as metal phthalocyanines, metal free phthalocyanines, hydroxygallium phthalocyanines, perylenes, especially bis(benzimidazo)perylene, titanyl phthalocyanines, and the like, and more specifically, vanadyl phthalocyanines, Type V chlorohydroxygallium phthalocyanines, and inorganic components, such as selenium, especially trigonal selenium. The photogenerating pigment can be dispersed in a resin binder similar to the resin binders selected for the charge transport layer, or alternatively no resin binder is needed. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 15 microns, and more specifically, from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. It is desirable to select a coating solvent that does not substantially disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference; phenolic resins as illustrated a the appropriate copending applications recited herein, the disclosures of which are totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesive layers usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 3 microns, and more specifically, about 1 micron. Optionally, this layer may contain effective suitable amounts, for example from about 1 to about 10 weight percent, conductive and nonconductive particles, such as zinc oxide, titanium dioxide, silicon nitride, carbon black, and the like, to provide, for example, in embodiments of the present invention further desirable electrical and optical properties.

Various suitable know charge transport compounds, molecules and the like can be selected for the charge transport layer, such as aryl amines of the following formula

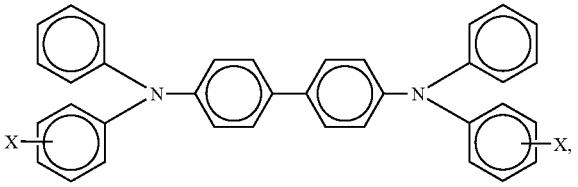

and wherein a thickness thereof is, for example, from about 5 microns to about 75 microns, and from about 10 microns to about 40 microns dispersed in a polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies, and block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

Illustrative photoresponsive imaging members were fabricated as follows.

A dispersion of a hole blocking layer solution was prepared by milling $TiO_2$ (MT-150W, manufactured by Tayca Co., Japan), a phenolic resin (VARCUM®) at a solid weight ratio of about 60 to about 40 in a solvent of about 50 to about 50 in weight of xylene and butanol, and a total solid content of about 52 percent in an attritor with about 0.4 to about 0.6 millimeter size $ZrO_2$ beads for 6.5 hours, and then filtering with a 20 μm Nylon filter. To the resulting dispersion was then added methyl isobutyl ketone in a solvent mixture of xylene, butanol at a weight ratio of 47.5:47.5:5 (ketone:xylene:butanol). A 30 millimeter aluminum drum substrate was coated using known dip coating techniques with the above formed dispersion at a pull rate of about 100 to about 350 mm/S. After drying a hole blocking layer of $TiO_2$ in the phenolic resin, binder about 6 to 20 μm in thickness was obtained.

A 0.2 micron photogenerating layer was coated on top of the hole blocking layer above, which photogenerating layer was prepared from a dispersion of hydroxygallium phthalocyanine and a binder of vinyl polymer polystyrene-b-polyvinylpyridine vinyl chloride-vinyl acetate-maleic acid terpolymer in 20 grams of a 1:1 mixture of n-butylacetate: xylene solvent. Subsequently, a 28 micron charge transport layer (CTL) was coated on top of the photogenerating layer from a solution of N,N'-diphenyl-N,N-bis(3-methyl phenyl)-1,1'-biphenyl-4,4'-diamine (31 grams), N,N'-bis-(3,4-dimethylphenyl)-4,4'-biphenyl amine (17 grams), and a polycarbonate (5.2 grams) in 50 grams of a 3:1 mixture of tetrahydrofuran and toluene.

The xerographic electrical properties of the imaging members can be determined by known means, including as indicated herein electrostatically charging the surfaces thereof with a corona discharge source until the surface potentials, as measured by a capacitively coupled probe attached to an electrometer, attained an initial value $V_o$ of about −700 volts. Each member was then exposed to light from a 670 nanometer laser with >100 erg/cm$^2$ exposure energy, thereby inducing a photodischarge which resulted in a reduction of surface potential to a Vr value, residual potential.

| Device | $TiO_2$ | Hole Blocking Layer Thickness | V(4.5) | Residual Potential |
|---|---|---|---|---|
| 1 | MT-150W | 6.1 | 110 | 60 |
| 2 | MT-150W | 10.0 | 125 | 74 |
| 3 | MT-150W | 14.7 | 135 | 84 |
| 4 | MT-150W | 18.8 | 140 | 90 |
| 5 | STR-60N | 3.4 | 97 | 50 |
| 6 | STR-60N | 5.8 | 130 | 84 |
| 7 | STR-60N | 8.9 | 146 | 125 |
| 8 | STR-60N | 11.7 | 185 | 160 |

MT-150W: 15 nanometers of $TiO_2$ with a surface treatment of sodium metaphosphate.
STR-60N: 15 nanometers of $TiO_2$ without any surface treatment.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A photoconductive member comprised of a supporting substrate, a hole blocking layer thereover, a photogenerating layer, and a charge transport layer, and wherein the hole blocking layer is comprised of a metallic component and a binder component; wherein the metallic component has an aspect ratio of from about 4 to about 5, and wherein said oxide is optionally surface treated with from about 1 to about 3 percent by weight of an alkali metal, and wherein said metallic component possesses a powder resistance of from about $1\times10^4$ to about $6\times10^4$ ohm/cm when applied at a pressure of from about 650 to about 50 kg/cm$^2$.

2. A member in accordance with claim 1 wherein said metallic component is $TiO_2$, and the binder is a phenol resin.

3. A member in accordance with claim 2 wherein said metallic component is a metal oxide, and which oxide is of a size diameter of from about 10 to about 100 nanometers, and wherein said oxide possesses a primary particle size diameter of from about 10 to about 25 nanometers.

4. A member in accordance with claim 2 wherein said titanium dioxide is present in an amount of from about 20 to about 90 weight percent and which oxide possesses a primary particle size diameter of from about 12 to about 17 nanometers.

5. A member in accordance with claim 2 wherein said titanium dioxide is present in an amount of from about 30 to about 80 weight percent, and wherein said binder is a phenolic resin, and wherein said titanium oxide possesses a primary particle size diameter of from about 12 to about 16 nanometers, an aspect ratio of from about 4 to about 5, and wherein said oxide is optionally surface treated with from about 1 to about 3 percent by weight of sodium metaphosphate, and wherein said oxide possesses a powder resistance of from about $1\times10^4$ to about $6\times10^4$ ohm/cm when applied at a pressure of from about 650 to about 50 kg/cm$^2$.

6. A member in accordance with claim 2 wherein said binder is a resin present in an amount of from about 50 to about 95 weight percent, and wherein said titanium oxide possesses a primary particle size diameter of from about 12 to about 16 nanometers, an aspect ratio of from about 4 to about 5, and wherein said oxide possesses a powder resistance of from about $1\times10^4$ to about $6\times10^5$ ohm/cm when applied at a pressure of from about 650 to about 50 kg/cm$^2$.

7. A member in accordance with claim 2 wherein said binder is phenolic resin present in an amount of from about 96 to about 98 weight percent wherein said titanium oxide possesses a primary particle size diameter of from about 10 to about 17 nanometers, an aspect ratio of from about 4 to about 5, and wherein said oxide is surface treated with from about 1 to about 3 percent by weight of sodium metaphosphate, and wherein said oxide possesses a powder resistance of from about $1\times10^4$ to about $6\times10^4$ ohm/cm when applied at a pressure of from about 650 to about 50 kg/cm$^2$.

8. A member in accordance with claim 2 further including in said hole blocking layer an electron transport component of N,N'-bis(1,2-dimethylpropyl)-1,4,5,8-naphthalenetetracarboxylic acid; bis(2-heptylimido) perinone; BCFM, butoxy carbonyl fluorenylidene malononitrile; benzophenone bisimide; or a substituted carboxybenzylnaphthaquinone.

9. A member in accordance with claim 8 wherein said electron transport component is N,N'-bis(1,2-dimethylpropyl)-1 ,4,5,8-naphthalene tetracarboxylic acid.

10. A member in accordance with claim 8 wherein said electron transport component is bis(2-heptylimido)perinone.

11. A member in accordance with claim 8 wherein said electron transport component is a butoxy carbonyl fluorenylidene malononitrile.

12. A member in accordance with claim 8 wherein said substituted carboxybenzylnaphthaquinone is substituted with alkyl.

13. A member in accordance with claim 8 wherein said electron transport component is benzophenone, and the binder is a phenolic resin or a polycarbonate.

14. A member in accordance with claim 8 wherein said electron transport component is present in an amount of from about 1 to about 15 weight percent.

15. A member in accordance with claim 8 wherein said electron transport component is selected in an amount of from about 2 to about 10 weight percent.

16. A member in accordance with claim 1 wherein said hole blocking layer is of a thickness of about 2 to about 12 microns.

17. A member in accordance with claim 1 comprised in the following sequence of said supporting substrate, said hole blocking layer, an optional adhesive layer, said photogenerating layer, and said charge transport layer, and wherein said transport layer is a hole transport layer, and wherein said hole blocking layer is comprised of a titanium oxide which possesses a primary particle size diameter of from about 12 to about 17 nanometers, an aspect ratio of from about 4 to about 5, and wherein said oxide is optionally surface treated with from about 1 to about 3 percent by weight of sodium metaphosphate, and wherein said oxide possesses a powder resistance of from about $1\times10^4$ to about $6\times10^4$ ohm/cm when applied at a pressure of from about 650 to about 50 kg/cm$^2$.

18. A member in accordance with claim 17 wherein the adhesive layer is comprised of a polyester with an $M_w$ of from about 45,000 to about 75,000, and an $M_n$ of from about 25,000 to about 40,000.

19. A member in accordance with claim 17 wherein the supporting substrate is comprised of a conductive metal substrate, and optionally which substrate is aluminum, aluminized polyethylene terephthalate, or titanized polyethylene terephthalate.

20. A member in accordance with claim 1 wherein said photogenerator layer is of a thickness of from about 0.05 to about 10 microns, and wherein said transport layer is of a thickness of from about 10 to about 50 microns.

21. A member in accordance with claim 1 wherein the photogenerating layer is comprised of photogenerating pigments in an optional amount of from about 5 percent by weight to about 95 percent by weight dispersed in a resinous binder, and optionally wherein the resinous binder is selected from the group consisting of polyesters, polyvinyl butyrals, polycarbonates, polystyrene-b-polyvinyl pyridine, and polyvinyl formals.

22. A member in accordance with claim 1 wherein the charge transport layer comprises aryl amines, and which aryl amines are of the formula

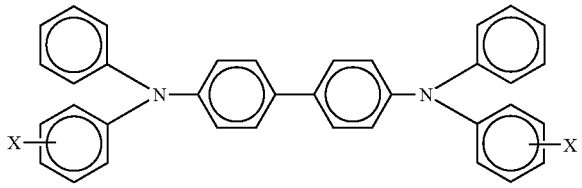

wherein X is selected from the group consisting of alkyl and halogen.

23. A member in accordance with claim 22 wherein alkyl contains from about 1 to about 10 carbon atoms, or wherein alkyl contains from 1 to about 5 carbon atoms, halogen is chloride, and optionally wherein there is further included in said transport layer a resinous binder selected from the group consisting of polycarbonates and polystyrenes.

24. A member in accordance with claim 22 wherein the aryl amine is N,N'-diphenyl-N,N-bis(3-methyl phenyl)-1,1'-biphenyl-4,4'-diamine.

25. A member in accordance with claim 1 wherein the photogenerating layer is comprised of metal phthalocyanines, hydroxygallium phthalocyanines, chlorogallium phthalocyanines, or metal free phthalocyanines.

26. A member in accordance with claim 1 wherein the photogenerating layer is comprised of titanyl phthalocyanines, perylenes, or halogallium phthalocyanines.

27. A member in accordance with claim 1 wherein the photogenerating layer is comprised of chlorogallium phthalocyanines.

28. A method which comprises generating an image on the member of claim 1, developing the image, and optionally transferring the developed electrostatic image to a suitable substrate.

29. A member in accordance with claim 1 wherein said hole blocking layer is of a thickness of about 10 to about 15 microns.

30. A member in accordance with claim 1 wherein said member comprises, in sequence, said supporting layer, said hole blocking layer, said photogenerating layer, and said charge transport, and wherein said charge transport is a hole transport; and wherein said hole blocking layer is comprised of a titanium oxide wherein said titanium oxide possesses a primary particle size diameter of from about 11 to about 18 nanometers.

31. A member comprised of a supporting substrate, a hole blocking layer thereover, a photogenerating layer, and a charge transport layer, and wherein the hole blocking layer is comprised of a metallic component and a binder component, and wherein said metallic component is a titanium dioxide, and wherein said titanium oxide is surface treated with an alkali metal salt, and wherein said oxide possesses a powder resistance of from $1\times10^4$ to about $6\times10^4$ ohm-cm when applied at a pressure of from about 650 to about 50 kg/cm$^2$.

32. A member in accordance with claim 31 wherein said alkali metal salt is sodium metaphosphate.

33. A photoconductive member comprised in sequence of an optional supporting substrate, a hole blocking layer thereover, a photogenerating layer, and a charge transport layer, and wherein said hole blocking layer is comprised of a titanium oxide or a titanium dioxide component, and a binder component wherein said titanium oxide possesses a primary particle size diameter of from about 12 to about 18 nanometers and an aspect ratio of from about 4 to about 5, and wherein said oxide is optionally surface treated with from about 1 to about 3 percent by weight of sodium metaphosphate, and wherein said oxide possesses a powder resistance of from about $1\times10^4$ to about $6\times10^4$ ohm/cm when applied at a pressure of from about 650 to about 50 kg/cm$^2$.

* * * * *